US006467300B1

(12) United States Patent
Noble, III

(10) Patent No.: US 6,467,300 B1
(45) Date of Patent: Oct. 22, 2002

(54) REFRIGERATED INTERCOOLER

(75) Inventor: John O. Noble, III, 4803 Ramus St., Houston, TX (US) 77092-8016

(73) Assignee: John O. Noble, III, Houston, TX (US)

( * ) Notice: Subject to any disclaimer, the term of this patent is extended or adjusted under 35 U.S.C. 154(b) by 0 days.

(21) Appl. No.: 09/818,198

(22) Filed: Mar. 27, 2001

(51) Int. Cl.[7] ..... F25B 43/02; F25B 43/00; F25B 41/00

(52) U.S. Cl. ..... 62/472; 62/503; 62/513

(58) Field of Search ..... 62/468, 513, 471, 62/472, 503, 477

(56) References Cited

U.S. PATENT DOCUMENTS

| | | | | | |
|---|---|---|---|---|---|
| 2,770,105 | A | * | 11/1956 | Colton | 62/503 |
| 3,171,268 | A | | 3/1965 | Silver | |
| 4,341,092 | A | * | 7/1982 | Davis | 62/475 |
| 4,474,034 | A | * | 10/1984 | Avery | 62/503 |
| 4,617,808 | A | * | 10/1986 | Edwards | 62/472 |
| 4,696,168 | A | | 9/1987 | Woods et al. | |
| 5,245,833 | A | * | 9/1993 | Mei et al. | 62/113 |
| 5,622,055 | A | * | 4/1997 | Mei et al. | 62/113 |
| 5,970,738 | A | * | 10/1999 | DeNolf et al. | 62/474 |
| RE36,408 | E | | 11/1999 | Yamanaka et al. | |
| 6,058,727 | A | * | 5/2000 | Fraser et al. | 62/190 |
| 6,253,572 | B1 | * | 7/2001 | Bottum et al. | 62/509 |

OTHER PUBLICATIONS

"Scroll compressor pressure spikes and variable orifice tubes" Feb. 2001 issue of MACS Service Reports, pp. 3–5.

* cited by examiner

*Primary Examiner*—William C. Doerrler
(74) *Attorney, Agent, or Firm*—Kenneth A. Keeling; Keeling Hudson LLC

(57) ABSTRACT

A refrigerated intercooler for an air conditioning, refrigeration or similar cooling system. The intercooler provides a thermal interface between colder refrigerant gas leaving the air conditioning system's evaporator and the hotter refrigerant liquid leaving the system's condenser. The thermal interface occurs between the gas in the accumulator portion of the intercooler and the liquid in an interior container of the intercooler. In the preferred embodiment, the interior container is coiled tubing, to promote better heat exchange. The system's oil/refrigerant emulsion is metered and returned from the intercooler to the compressor through an oil return line that is external to the accumulator portion of the intercooler.

25 Claims, 5 Drawing Sheets

REFRIGERATED INTERCOOLER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

This invention is directed toward improved performance of stationary and mobile air conditioning systems and other similar cooling systems by reducing the amount of saturated heat during the gas-to-liquid phase change in the condenser. To accomplish this objective, an intercooler device is placed between the condenser and evaporator, which enables more complete refrigerant condensation by improving the efficiency of the phase change. Such liquid refrigerant delivered to the evaporator, typically after passing through an expansion valve, arrives further below the critical temperature than before, with less saturated heat, and is thereby enabled to absorb more new heat during the evaporation phase than would be possible without the device. The intercooler is suitable for mobile and stationary air conditioning and refrigeration applications because of its ability to capture and recycle the otherwise wasted heat absorption capacity of the cold return gas. The operational improvement that is most immediately noticed by the user of the invention is the faster cool-down time and lower duct temperature achieved on a hot day compared with systems that are not fitted with the disclosed device. The differences are easier to identify when there is a high ambient heat load because systems not equipped with the device are not able to keep up in such hot weather. Systems with the device achieve faster cool-down times and lower temperatures, therefore greater comfort levels. Government, military, public and private sectors of the economy will benefit from the use of this invention.

In high heat and humidity areas, such as along the U.S. Gulf Coast, where the summer is long and intense, air conditioners and refrigeration systems frequently cannot keep up with the demands placed upon them. Hot and humid climates subject an air conditioning or refrigeration system to greater heat loads than such systems found in cooler climates. For example, in cities along the Gulf of Mexico, an air conditioner must perform efficiently during six to eight months of hot weather during the year, often having many weeks when daily temperatures range between 90–103° F.

Aftermarket enhancements are frequently needed to overcome built-in engineering deficiencies in factory systems. Manufacturers frequently do not produce systems, which are able to function well in hot climates, and many condensers do a poor job of giving up heat because of their inefficient designs and/or poor airflow through them. For example, the lack of airflow produced by fan clutches is a common reason for the inability of condensers to give up heat. Automobile engine fan clutches have notoriously poor engineering, and frequently won't do an adequate job in high heat load climates. Technicians are often not taught how to properly test fan clutches, thus high head pressures are ignored and continue to reduce condenser efficiency affecting the entire system like a low grade fever, e.g., the compressor works harder and fails prematurely, the engine consumes more fuel, etc. The problem of condenser fan inefficiency is not as prevalent on commercial heating, ventilation and air conditioning (HVAC) systems because they are electrically driven, and are generally not of the slip type viscous engagement design. However, by lowering the saturated heat levels and higher head pressures, the present invention can provide lower fuel costs, lower temperatures, and faster cool-down on both mobile and stationary applications. The second issue of condenser efficiencies can be summarized by stating that the new generation of high efficiency condensers has become a necessity because of the more problematic R134a, which is now the refrigerant of choice by manufacturers.

To obtain a better understanding of why systems not equipped with the present invention do not perform up to their potential, two basic principles of the a/c-refrigeration system heat transfer process must be understood. Technically, air conditioning and refrigeration systems do not make cold air; they remove heat (evaporation cycle); then they give up heat (condensation cycle). After the evaporator picks up heat from the air inside the compartment to be cooled, the condenser has to return that heat (usually back to the atmosphere). If the condenser cannot effectively give up the heat absorbed by the evaporator, then the heat soaked liquid leaving the condenser reenters the evaporator unable to accept as much new heat as it should. The result is occupant discomfort, longer cool-down time and unacceptably high head pressures. Vehicle a/c systems are not able to remove enough heat from the passenger compartment to provide a sufficient comfort level when driving on short trips, or only provide a marginal level of cooling on longer trips for passengers in the rear of the vehicle. In the case of homes and commercial buildings, the same inefficiencies, high pressures, and creature discomfort problems occur. Systems not equipped with the invention exhibit greater high side pressures, which cause the compressor to work harder, reducing its life and increasing fuel consumption and operating costs. Condensers are unable to fully condense that overheated liquid before feeding it to the evaporator. Condenser manufacturers now have the burden of providing designs that are 25–40% more efficient than were required with the more efficient, but almost depleted supply of, R12 refrigerant. Condensers must now be designed to compensate for the inefficiency of the new R134a, and other refrigerants having similar characteristics such as higher critical temperatures and working pressures than R12. Regardless of which refrigerant is used, because evaporators are rendered less efficient by being fed heat-saturated liquid, they lack the ability to effectively absorb new heat. Systems equipped with a refrigerated intercooler provide better heat dissipation during the condensation cycle so that better heat acceptance can be achieved during the evaporation cycle.

The term critical temperature is defined as the temperature above which a gas cannot be liquefied, regardless of how much pressure is applied. This is important because refrigerants resist staying liquid when acted upon by heat. Heat is absorbed into an a/c or refrigeration system, not just from air passing across the evaporator, but also from the very hot under-hood engine temperatures. One such example is the problem of "heat soak" from the engine radiator to the a/c condenser due to their near proximity. For the expansion valve to do its job effectively, it needs to meter a fully condensed, non heat-saturated liquid refrigerant into the evaporator.

The solution to the problem of excessive saturated heat within the condenser and its downstream liquid line is to reduce that heat load well below the critical temperature of prevailing refrigerants used in modern air conditioning and refrigeration systems. This is achieved by precooling the liquid going to the evaporator, making all refrigerant in the closed system cooler.

The theory of why better performance is achieved when using this invention is confirmed by field testing. After observing improved cool-down time, and lower duct temperatures on systems equipped with the apparatus, it has been concluded that the heat absorption capacity of evaporators, and the heat rejection capacity of condensers are underutilized. By intercooling the liquid stream between condenser outlet and evaporator inlet, the following results occurred: (a) Maximum cooling was achieved prior to reaching the factory specified charge level, and adding more refrigerant resulted in an overcharge with diminished cooling. (b) Faster cool-down time occurred. (c) Lower head pressures resulted because the cooler and lesser volume of refrigerant being compressed by the compressor resulted in more efficient condensation, creating greater expansion space in the condenser. Comparative readings were taken before and after the apparatus was installed. The field observations confirm that when equipped with the apparatus, almost any original equipment manufactured (OEM) condenser and evaporator combination exhibited these improved performance characteristics compared to those previously attained when not equipped with the apparatus.

As noted above, insufficient airflow across the condenser because of poorly designed mechanical fan clutches on automobile a/c systems is one of the most overlooked service items by technicians. The only way to properly check a fan clutch is to do a performance test on the a/c system. A cold engine should be run at fast idle (1500–2000 rpm) with the evaporator fan on high speed and passenger doors open, while watching the high side pressure gage. If the fan is working correctly, even on a 95–100° F. day, the reading should correct back to 250–275 psi (without the intercooler) prior to exceeding 350 psi and before the elapse of 30 seconds. On systems with defective fans, but without the intercooler, the system will exhibit high side pressure readings of 300–430 psi, yet the engine temperatures will be normal. Thus, normal engine temperatures do not indicate that the fan clutch is working. The point is that an a/c condenser requires much more airflow than an engine radiator. Manufacturers have yet to adequately address this problem with a meaningful solution. No air conditioning system can function properly under those conditions. It is understood, however, that the present invention is not to be used to mask latent system defects (defective condenser fan, etc.), but that the system would be restored to good operating condition prior to installing the apparatus.

After installing the intercooler, the above head pressures dropped to readings of 225–250 psi, under the same operating conditions that previously produced 300–425 psi (without the intercooler). Outlet air temperatures were colder and the cool-down time was shorter. While field tests show that performance results will vary from vehicle to vehicle, based on system design and repair status, all achieved improved cool-down time using the present invention.

A question may arise as to "why wouldn't introducing a greater heat load back into the condenser result in worsening system inefficiency?" One reason is that a system equipped with the preferred device requires less refrigerant than before, thus making it easier for complete vaporization to occur within the evaporator because of the lower saturated heat in the liquid stream as it enters the expansion valve. Less heat-saturated liquid entering the evaporator means that as vaporization occurs, more heat can be absorbed without exceeding an efficient superheat level, unlike systems not equipped with the device. A lower superheat is achieved during vaporization (evaporation cycle) because the total system has first become more efficient at processing refrigerant during liquefication (condensation cycle.) The phase changes from liquid to gas, then from gas back to liquid are now complimentary instead of struggling against each other. To accomplish this, however, the condenser must be more efficient. Most systems contain more refrigerant than is required to achieve best efficiencies, but without refrigerated intercooling their charge levels cannot be lowered and they cannot perform up to their potential.

To further understand why condenser efficiency is one of the keys to total system efficiency, the following field observations and conclusions are also submitted. The greatest amount of saturated heat is found in liquid within the lower third of the condenser. Condensers have a limited amount of expansion space. When liquid backs up in the condenser above approximately one third of its vertical height, the result is inadequate vaporization within the evaporator due to the saturated heat still in the refrigerant. This unbalanced ratio between the evaporation phase and condensation phase also means inefficient refrigerant circulation, system-wide.

Refrigerant is supposed to be changed from a hot gas to a cooler liquid within the condenser as ambient air passes through its exterior fins, releasing heat back to atmosphere. That is not done very efficiently in many applications. After installing a refrigerated intercooler, the condenser is no longer totally responsible for condensing hot gas back to a liquid. Using the invention's interface allows heat transfer from the hot liquid section to the cold gas section of the interaction device. The cooled liquid is able to release additional heat to the cold return gas, which results in beneficial lower head pressures, duct temperatures, and faster cool-down time. Again, the system is no longer totally dependant on the condenser for complete condensation.

In summary, when prior art uses single components that are individually similar to the three base components of the invention, they are less efficient because of the differences in the way that they interface with each other. Prior art systems, especially receivers, are generally non-serviceable without system disassembly, due to their physical construction. In cases when they have serviceable features, or have the same intent and purpose, they differ from the present invention in other ways that negate the benefit of such similarities. The advantages of the invention shall become apparent in the disclosure and claims hereof.

2. Related Art

Prior art includes that described by Davis (U.S. Pat. No. 4,341,092). As shown in FIG. 2, Davis teaches a liquid modulator receiver/dryer having an interfacing of the hot liquid refrigerant from the condenser with the cold gas refrigerant from the evaporator to lower the latent heat in the liquid refrigerant. However, the present invention is able to perform this function more efficiently without the use of a receiver or drier, due to the improved accumulator and oil return design.

Cool refrigerant coming from the evaporator contains inherent amounts of oil, primarily from compressor pump lubrication. The oil/refrigerant mixture must not return in liquid form to the compressor, else it will damage the gas compressor. To vaporize this mixture in the return line to the compressor from the accumulator, Davis depends solely on the phase change from liquid to gas of this mixture in the accumulator, aided by the heat transfer from the receiver canister inside the accumulator. System oil/refrigerant is screen filtered within the receiver at the bottom of the pick-up tube, which leads to the evaporator. Servicing the screen requires complete disassembly of the receiver.

Davis' oil/refrigerant return orifice is fixed and not interchangeable. Thus, there is no selective orifice replacement or sizing to accommodate the variety of manufacturer's equipment btu-ratings that affect oil/refrigerant return flow rate requirements. Because of the configuration of the receiver, Davis requires the use of a drier within or associated with the interaction device (gas and liquid chambers interface), to reduce the potential for acid and moisture encroachment systemwide. Unfortunately, desiccant deterioration and resultant system contamination has long been a worse problem. With the preferred device, system acids and moisture removal is accomplished by periodic flushing and service, thus eliminating the need for desiccant as an embodiment of its function.

Other prior art falls short of addressing the need to use a colder than ambient medium to subcool condenser liquid. Yamanaka et al (U.S. Pat. No. Re. 36,408) teaches a method of recirculating refrigerant with the condenser to create a boundary between the liquid phase and the gas phase, but does not use the cold return gas (from the evaporator) in the method.

It would therefore be useful improvement of the prior art for a mobile air conditioning system to not have the limitations of the prior art, including those described above.

BRIEF SUMMARY OF THE INVENTION

The intercooler consists of three "base" components which can be configured in various ways to provide the results described above in the stated invention objects. These cooperative components are:

- the cold gas chamber component,
- the hot liquid chamber component inside the cold gas chamber component, and
- the oil return line assembly component outside the cold gas chamber component, consisting of a cleanable screen and a replaceable metering orifice within a housing. The oil return line assembly and its internal oil movement extend in the direction of the gas flow.

The inventive intercooler can be described as a "refrigerated intercooler", "heat exchanger," "condenser intercooler," or "refrigerant liquefier" which uses the cold refrigerant return gas to subcool hot liquid refrigerant after it leaves the condenser, preparing it for delivery to the expansion valve. The invention contains two sections of the heat exchange device (gas and liquid sections). They are separate pressure vessels that interact with each other by their physical proximity to one another. The result of their interaction is that a coalescing interface is created which provides efficient heat transfer between them. These co-dependent heat exchange devices may be designed of any convenient shape and/or size to achieve the best transfer of heat from the higher pressure liquid to the adjacent lower pressure cold return gas. A cold return gas accumulator may be used to house the hot higher pressure liquid section, while the hot higher pressure liquid section may be used to house the cold return gas accumulator. They must coalesce to effect heat transfer without commingling, mixing or to otherwise compromise the separateness of the pressure vessels that confine the gas and liquid paths.

The preceding paragraph describes the heat transfer from the liquid section to the gas section. It must also be pointed out that the heat absorbed into the compressor return gas stream also is a function of the invention, i.e., it carries the heat for disposition at the condenser. This results in two phenomenons. First, the condenser's heat rejection capacity is more filly utilized, resulting in an improved phase change. Second, the evaporative phase change improves because the evaporator is now fed a cooler, better condensed liquid. Third, the refrigerant charge level is now lower while the total system efficiency is higher.

Accordingly, this invention provides, inter alia, a new and improved method of and device for intercooling air conditioning refrigerant according to the following objectives.

An object of the invention is to shorten the cool-down time between air conditioning system start-up and maximum cooling.

A further object of the invention is to lower the maximum outlet air temperature to achieve improved comfort.

A still further object of the invention is to lessen the negative impact on consumer comfort because of the EPA-mandated phaseout of R12, which has resulted in less cooling after retrofitting or conversion of a/c systems from their original refrigerant to an alternate refrigerant.

An object of the invention is to provide lower fuel costs as a result of lowering the power consumption required to operate the system.

A further object of the invention is to reduce the refrigerant charge level required to service the system, while achieving the above objectives. Benefits would be the reduced refrigerant costs to the manufacturer and/or consumer, and less ozone depletion potential to the atmosphere.

A still further object of the invention is to provide a method of gas flow through the accumulator so that a better interface between the gas and liquid sections would enhance heat absorption by the gas, and heat removal from the liquid.

An object of the invention is not only to make the gas and liquid interface more efficient but also to make it less subject to desiccant contamination by eliminating the presence of a drier as a feature of its design.

A further object of the invention is to eliminate the need for a receiver on air conditioning systems. Until about 1976, receivers were a requirement on virtually all OEM and aftermarket systems to insure that liquid was fed to the expansion valve, even if such liquid was saturated with heat. Starting in 1977 when clutch cycling orifice tube systems (CCOT) became popular among vehicle manufacturers, accumulators replaced receivers, but the same heat-saturated liquid problem remained. Today, some prior art aftermarket products require the use of both an accumulator plus a receiver and drier, such as the Liquid Modulator (Davis).

A still further object of the invention is to intercool liquid refrigerant leaving the condenser using the evaporative return gas to substantially reduce the saturated heat in the liquid; thus, upon such prepared liquid being metered into the evaporator by the expansion valve, the resultant vaporized gas is able to absorb new heat more efficiently.

An object of the invention is to provide a means to selectively install, clean and/or replace an oil metering orifice, in order to satisfy the oil return requirements based on the manufacturer's btu rating and other operating criteria.

A further object of the invention is to provide an external means to clean the oil return screen of various system residues and debris that may build up and block the flow of lubrication necessary to the longevity of the compressor.

A still further object of the invention is to provide a means to flush the interior surfaces of the accumulator, liquid chamber, and screen, to allow the entire intercooler to be flushed, reassembled, then reinstalled, rather than to be replaced.

An object of the invention is to refrigerate the condenser's downstream hot liquid in order to provide a supplement for the lower volume and higher temperature of ambient airflow across the condenser. The low volume air is caused by (a) insufficient ram air due to slow vehicle speed or when idling in traffic, (b) air restrictions caused by objects in front of the condenser such as the grill, or transmission oil cooler, etc., (c) an inefficient mechanical or electrical fan.

A further object of the invention is to improve the efficiency of internally and externally equalized type expansion valves by reducing the temperature of the incoming liquid stream. When the temperature of the incoming liquid stream is too high, the pilot valve's metering action is adversely affected. The result is that the wrong amount of refrigerant is fed into the evaporator, and the evaporator is unable to digest the refrigerant as evidenced by an incomplete phase change. The effectiveness of a fixed orifice tube type expansion valve would likewise be enhanced.

A still further object of the invention is to address a basic problem that now plagues prevailing mobile and stationary HVAC systems, that of inefficient phase change during condensation which defeats phase change in the evaporator. Part of the problem is based on the chemistry differences in refrigerants. Refrigerants with a lower critical temperature are less efficient because they resist changing back to a gas more than those with a higher critical temperature. In the case of R134a, its comparatively low critical temperature results in the need for a more efficient condenser than R12, just to achieve the equivalent heat rejection capacity of the older R12.

A still further objective and advantage of the invention is that the external oil return filtering and metering features, along with the absence of an internal drier, means that the invention's internal parts are also totally cleanable, unlike prevailing accumulators, receivers and other such components which must be discarded when their desiccant is adsorbed with moisture, acid and/or system contaminations when they have formed a residue on interior surfaces.

A further object of the present invention is to re-vaporize refrigerant oil that has dropped out of solution with its carrier (liquid refrigerant), as well as liquid refrigerant itself, during the evaporative phase change. Liquid refrigerant enters the expansion valve and immediately undergoes a simultaneous rapid expansion and pressure drop. The abrupt transition causes some of the oil to temporarily drop out of solution because it cannot vaporize as readily as the refrigerant. This phenomenon indicates that it is more difficult for oil to stay in solution with refrigerant during the evaporative phase because of the scrubbing effect, which mechanically separates some of the oil as it passes through the expansion valve orifice. After falling out of solution, the oil must go back into solution with the evaporative refrigerant gas quickly in order to reach the correct oil-to-refrigerant blend ratio, otherwise it will arrive at the compressor without the proper lubricity. Total dependence on the evaporator for re-vaporization can result in oil starvation of the compressor, especially when chemical imbalances and/or contaminants cause oil dilution and the subsequent reduction of viscosity. The invention improves the efficiency of such oil vaporization by providing a secondary heat exchange interface as the final stage in the conversion of liquid into gas. It has been previously stated that whatever liquid is not vaporized is collected as a puddle and returned to the compressor through the accumulator outlet. The invention also helps maintain healthy oil chemistry by (a) reducing overall system stress as the result of achieving lower head pressures, and (b) providing better phase change efficiencies based on lower system charge level.

The problem for oil manufacturers has been to produce oils that have the following qualities:

(a) During the Evaporation Phase Change: The ability to convert from a hot oily liquid into a cold oily vapor rapidly enough to prevent unvaporized liquid oil ingestion ("slugging") damage to the compressor and/or to arrive at the compressor as a gas with a diluted oil-to-refrigerant ratio.

(b) During the Condensation Phase Change: The ability to rapidly convert from a hot, oily gas into a hot, oily, liquid.

(c) Dilution Resistance: The ability for oil to maintain its viscosity, lubricity, and the correct oil-to-refrigerant blend ratio during both of the above phase changes.

(d) CST Stability. Critical Solubility Temperature (CST) is the temperature at which the viscosity of oil will change enough to make it drop out of solution with the refrigerant. Synthetic oils such as PAG oil (polylkylene glycol) have superior lubricity qualities, but their viscosity is affected greatly by temperature. So, it is important that PAGS would be designed for use within the minimum and maximum temperature boundaries of a/c systems. The CST of oils varies by type and manufacturer, so the rate of oil vaporization and liquefication will also vary.

Furthermore, even if good oil solubility issues are addressed, system contamination factors which result in viscosity dilution and solubility reduction are additional reasons why compressor damage can occur in systems not equipped with the present invention. Attention is again drawn to the hot/cold interface by and between the oily vapor and the hot liquid container within the accumulator's interior region. The oily vapor and refrigerant droplets from the evaporator (drawn by the compressor suction pressure) are carried by the refrigerant gas into the accumulator inlet. The present invention, located downstream of the evaporator, accelerates and finalizes the vaporization phase change for any remaining liquids, and if oil solubility is diminished, the present invention helps to alleviate the problem.

A further object of the invention is that it serves as a compressor high pressure spike buffer. The scroll compressor has become popular among automobile manufacturers because of its high efficiency, smooth-running qualities. But, it has a tendency to cause more severe transient pressure spikes during rapid acceleration than piston compressors. The byproduct of its greater efficiency is that during 5 to 15-second, high rpm acceleration bursts, it is able to pump a greater mass of refrigerant into the condenser than the condenser can process. An advantage of systems equipped with the invention is that their improved condensation phase change efficiencies also provide greater expansion space because the liquid level within the condenser is lower than systems not so equipped. Thus the condenser can accept more new refrigerant into the top portion and act as an accumulator or shock absorber, reducing the magnitude of the high pressure spikes much better than systems not equipped with the device. Other strategies for handling these spikes include, but are not limited to installing: (a) a variable orifice tube which senses the spike and acts as a relief valve, dumping liquid refrigerant into the evaporator, (b) a hot gas bypass valve which senses the spike and dumps hot compressor discharge gas into the cold evaporative return line, (c) a variable-output compressor, able to sense and make sudden pressure reductions, and (d) methods of compressor clutch disengagement such as a wide-open throttle cutout relay which causes the compressor to quit pumping, thus it quits building up pressure. These alternate strategies all essentially prevent the compressor from pumping, whereas the present invention does not disrupt the volumetric advantages of any compressor, but makes provision for its extra needs.

These objectives are addressed by the structure and use of the inventive process. Other objectives of the invention will become apparent from time to time throughout the specification hereinafter disclosed.

DETAILED DESCRIPTION OF THE INVENTION

Figure 1:
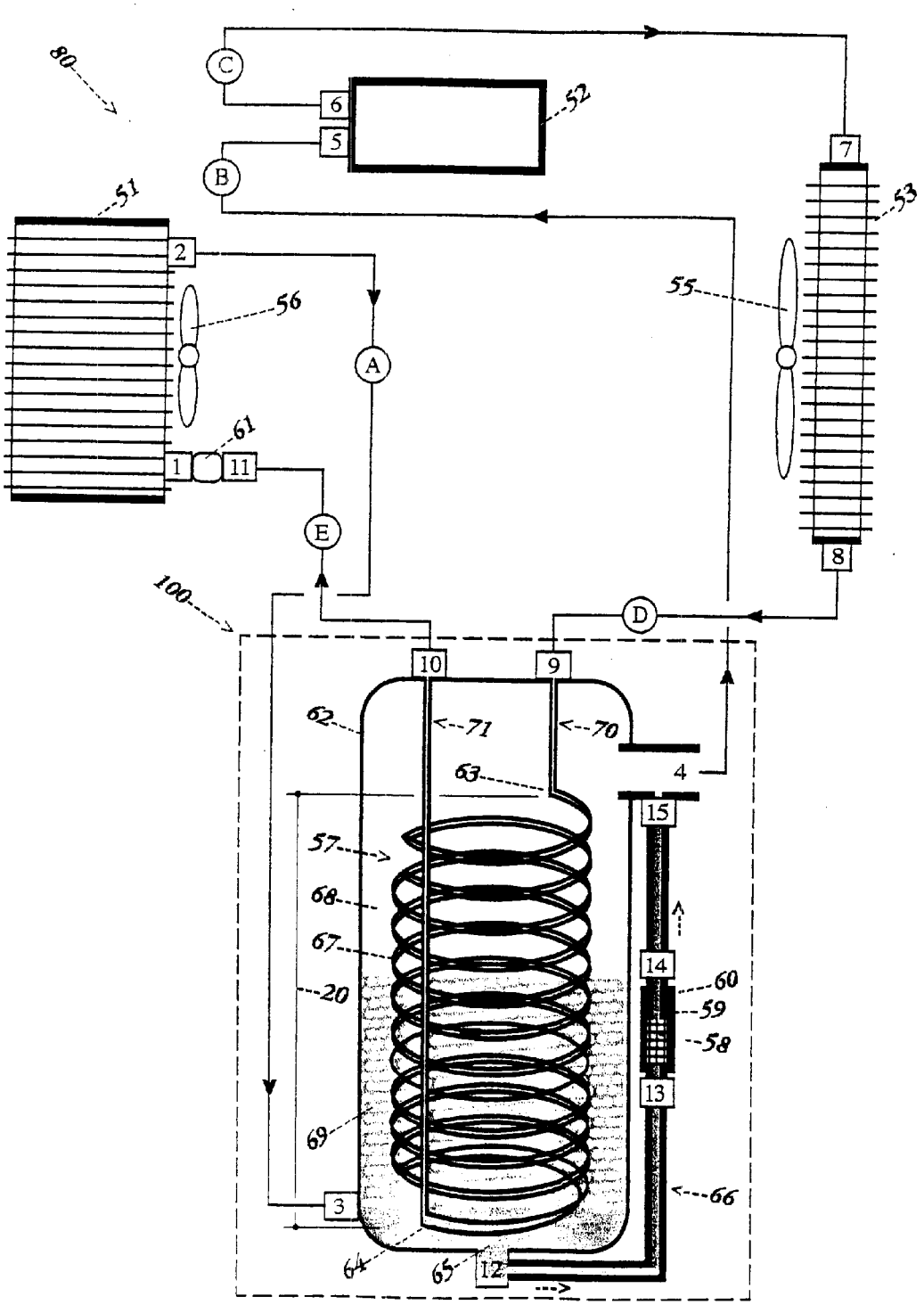
FIG. 1 depicts in block diagram form a preferred embodiment of the invention. The side view of the intercooler depicts the high-pressure liquid line coil interfacing with the cold return gas that surrounds and bathes the external surface area of the coil.
Figure 2:
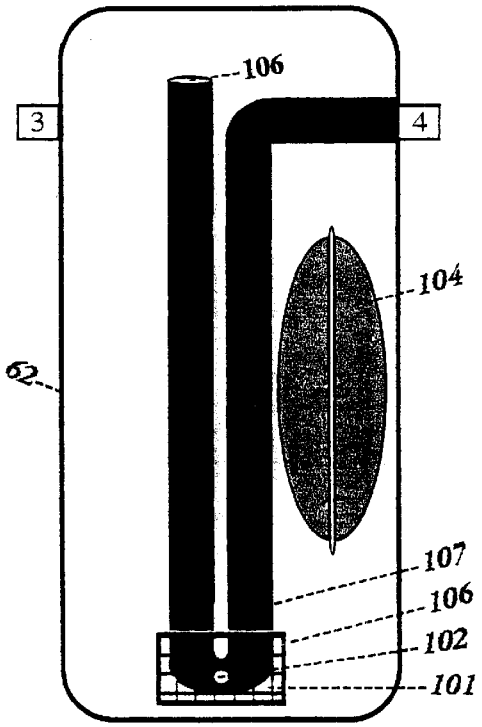
FIG. 2 Prior Art
FIG. 2 depicts a prior art "liquid modulator".

The present invention is described as intercooler 100, depicted as part of the block diagram form in FIG. 1.

The terms "intercooler", "refrigerated intercooler", "heat exchanger," "condenser aftercooler," or "refrigerant liquefier" are synonyms that describe the function of intercooler 100. Intercooler 100 acts as an intercooler because (a) its placement within air conditioning system 80 between condenser outlet 8 and expansion valve inlet 11 affords (b) heat transfer capability. The descriptive term "heat exchanger" is also accurate based on its heat transfer capability. Furthermore, intercooler 100 may be referred to as a "refrigerant liquefier" because it assures that even if condenser 53 does not efficiently condense hot oily gas into a hot oily liquid before its exit from condenser 53, the colder than ambient temperature within accumulator 62 completes the process of full liquefication. Intercooler 100 is also described as a "condenser aftercooler" since it completes the condensation of the refrigerant coming from condenser 53 by further cooling the refrigerant. It is noted that air conditioning system 80 may be either a mobile or stationary air conditioning system, or alternatively may be a refrigeration system, including but not limited to that of a freezer, refrigerator, process refrigeration, etc. Air conditioning system 80 as so collectively defined may be referred to as a cooling system.

In FIG. 1, the refrigerant path is shown for the improved air conditioning system 80 using intercooler 100. Cold oily gas refrigerant exits from evaporator 51 through line A to accumulator 62, through line B to compressor 52, from compressor 52 through line C as a hot oily gas to condenser 53, through line D as primarily a hot oily liquid refrigerant entering container 57 (being preferably coiled tubing 67) through container inlet 9, passing through entry tag end 70, exit tag end 71 and then out container outlet 10 and back through evaporator inlet 1 to evaporator 51. There is no receiver-drier as found in the prior art, because it is not required as an embodiment for the function of the invention. The receiver is not needed because there has been full liquefication of the refrigerant (thus providing a "liquid seal" at the expansion valve to the evaporator) prior to introduction to evaporator 51 (typically through expansion valve 61). This complete liquefication is due to 1) the lower heat load in the refrigerant in condenser 53 because of the heat transfer in intercooler 100, 2) the subsequent need for less refrigerant, resulting in less liquid accumulation in condenser 53 and thus more space in condenser 53 for refrigerant gas to be cooled, and 3) resulting total vaporization of the refrigerant in the evaporator.

This improved efficiency also reduces the need for desiccants, which have a tendency to pulverize into dust and sand-like particles and to migrate throughout the system. A better alternative to combat acids and corrosion is to periodically recover the old refrigerant, flush out impurities, evacuate, then recharge with clean refrigerant and oil.

Referring still to FIG. 1, the three base components which comprise the invention are the cold gas section accumulator 62, comprising accumulator inlet 3 and accumulator outlet 4; the hot liquid section container 57, comprising container inlet 9 and container outlet 10; and the compound external oil return line 66, comprising oil return line inlet 12, oil return line outlet 15, and oil return line housing 60 for cleanable, external oil return screen 58 and changeable and cleanable external oil bleed orifice 59.

Figure 3:
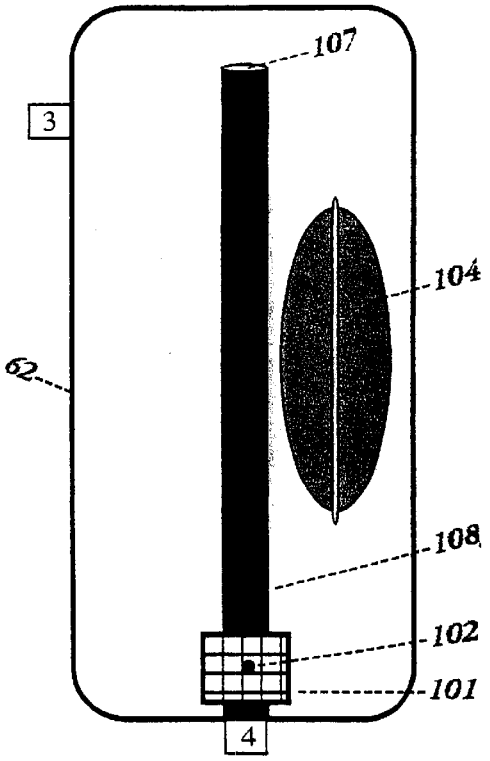
FIG. 3 Prior Art
FIG. 3 depicts a standard accumulator, illustrating a gas outlet tube of "horseshoe" design.
Figure 4:
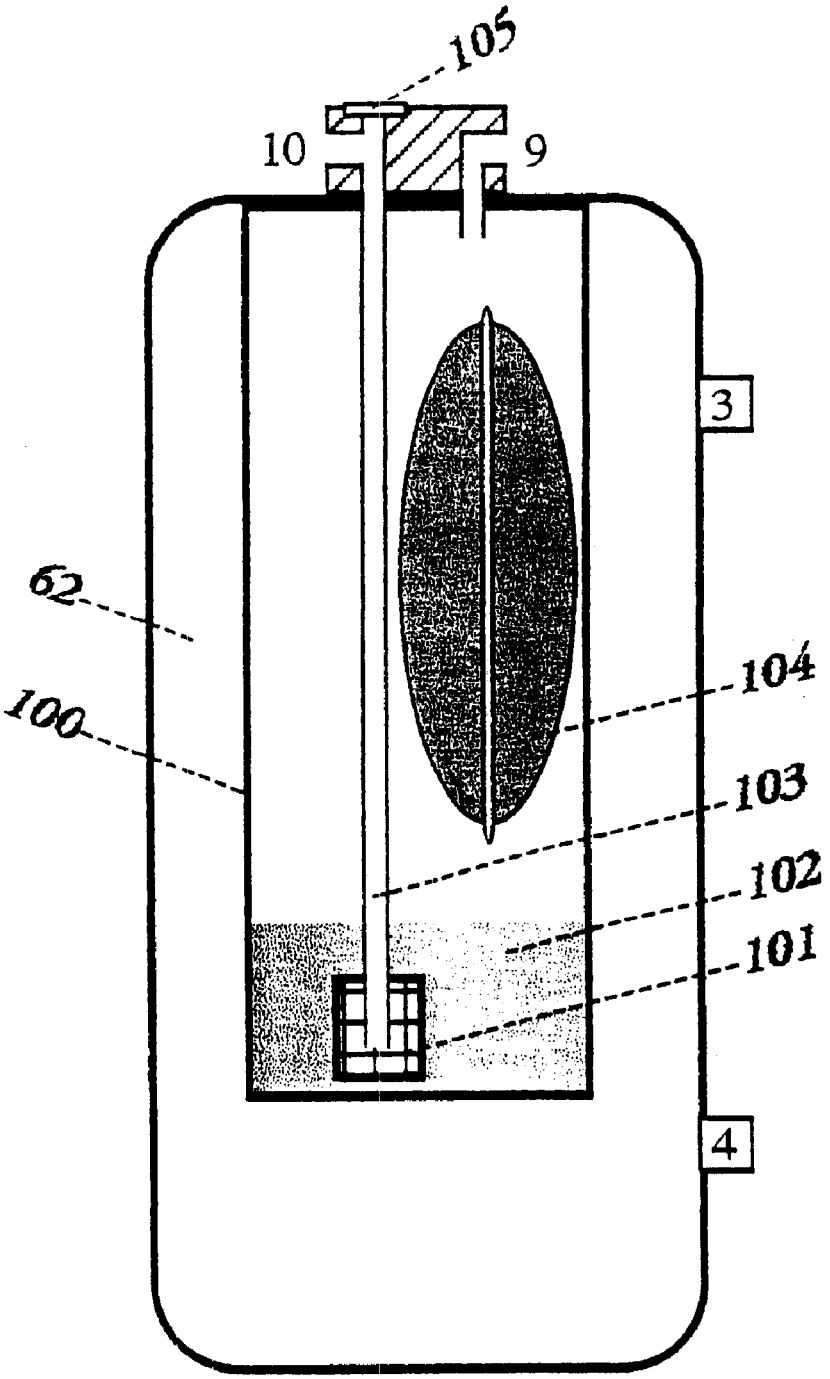
FIG. 4 Prior Art
FIG. 4 depicts a standard accumulator, illustrating a gas outlet tube of "standpipe" design.

The design purpose for all accumulators is for liquid separation, that is, to prevent "slugging" the compressor reed plates with liquid oil and/or refrigerant which are not compressible. Liquid separation can be accomplished in two scenarios, (a) best case, full vaporization of oil and refrigerant occurs leaving no residual oil or liquid refrigerant, or (b) worst case, full vaporization fails to occur, leaving a residual oil and liquid refrigerant pool at the lower end of the accumulator. The unvaporized oil returns back to the compressor (gradually through an oil return orifice), and vaporization of the unspent pool of liquid refrigerant gradually removes itself out of the accumulator with the other return gas. Prior art accumulators do not function well as vaporizing heat exchangers. This is because a bulky mass of desiccant (shown in the accumulators depicted in FIGS. 3 and 4) is an embodiment of their function (acid and moisture removal, corrosion control, etc.); therefore, the interior clutter reduces gas flow throughout the entirety of the chamber as illustrated in FIGS. 3 and 4. The present invention lacks such interior clutter, but provides a more efficient liquid chamber interface for heat transfer and minimizes the inlet to outlet pressure drop.

Figure 5:
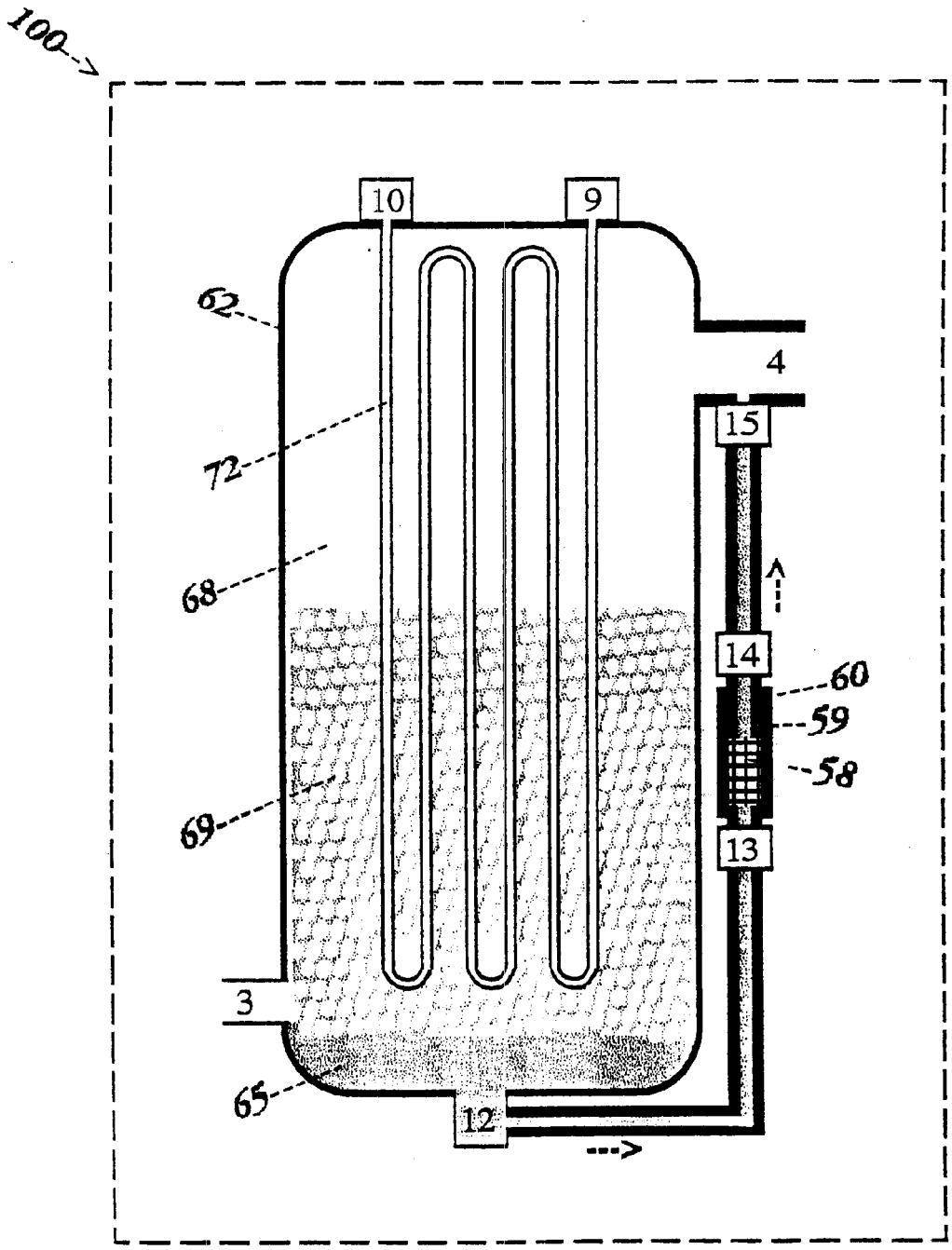
FIG. 5 depicts an alternate preferred embodiment of the hot liquid container inside the accumulator.
Figure 6:
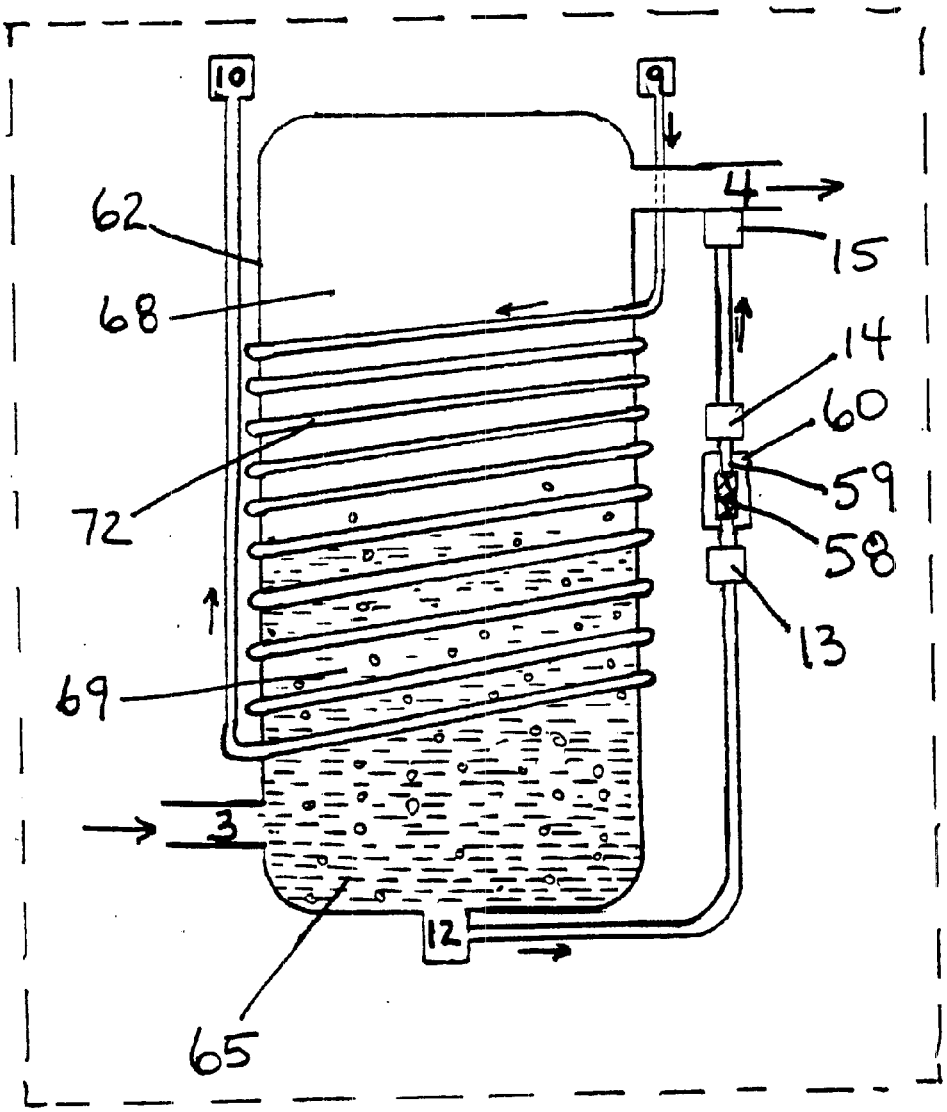
FIG. 6 depicts an exemplary embodiment of the hot liquid container outside the accumulator.

Still referring to FIG. 1, the shape of accumulator 62 is preferably cylindrical, although other shapes may be used. Accumulator 62 can be made from a wide variety of materials, but would normally be constructed of aluminum or steel. Within accumulator 62 is hot liquid section container 57, which is shown in FIG. 1 as a higher pressure refrigerant liquid coiled tubing 67 extending from container entry 9 to container exit 10, comprising straight entry tag ends 70 at the entry onward to the coil beginning 63 until the coil ending 64, from which exit tag end 71 rises upward to container exit 10, with a total number of coils designated by length 20. The hot liquid container 57 alternatively may be serpentine tubing 72, as depicted in FIG. 5. Serpentine tubing 72 is preferably constructed of straight tubing with return bends instead of coiled tubing. In any embodiment of container 57, the lower portion of container 57 is typically surrounded by cold oily vapor 69, which tends to condense about container 57 as the refrigerant passes across container 57 when moving from evaporator 51 to compressor 52.

As an illustration of the operation of the apparatus, attention is again directed to FIG. 1, which shows two major refrigerant paths designed so that they interact. The cold return gas, a cold oily gas, leaves evaporator outlet 2 through tube A into accumulator 62, through accumulator inlet 3 where it bathes the hot liquid container 57, which may be shaped as a tube (e.g. coiled tubing 67), cylinder (not shown), braised plate (not shown), finned tube (not shown), or any other effective liquid-carrying heat exchange device, then leaves accumulator 62 at accumulator outlet 4. As oil-laden refrigerant (referred to typically as "oil", although the "oil" is typically an emulsion of oil and refrigerant) vapor enters accumulator 62 at accumulator inlet 3 and interfaces with the hot liquid container 57 in accumulator interior 68, some refrigerant oil may be condensed, forming puddle 65 at the bottom end of accumulator 62. When such oil formation occurs, the internal gas pressure differential between accumulator inlet 3 and accumulator outlet 4 results in oil being drawn out through oil return line inlet 12 and into oil return line 66, where the lower gas pressure at accumulator outlet 4 moves the oil through return oil line housing inlet 13, through the cleanable oil return screen 58 and replaceable metering oil bleed orifice 59, onward through oil return line housing exit 14 to accumulator outlet 4, where oil is returned to compressor inlet port 5 through tube B. Again, note that "oil" is actually an emulsion of oil and refrigerant. The oil must return in gas or at least very fine mist form when returning to compressor 52. The oil that is not vaporized for flow from the interior of accumulator 62 into accumulator outlet 4 must be slowly metered into accumulator outlet 4 as a liquid. This careful slow metering is a primary purpose of oil return line 66. Oil bleed orifice 59 is sized to control this feed rate. Alternatively, oil return line 66 may have a fixed metering oil bleed orifice (not shown). Also, cleanable oil return screen 58 and replaceable metering oil bleed orifice 59 may be a single replaceable unit (not shown.) Alternatively, while oil bleed orifice 59 has been depicted as a separate insert in oil return line housing 60, the function of oil bleed orifice 59 can also be accomplished by a smaller diameter inlet tube within the entire length of oil return line 66, or preferably downstream of oil return screen 58.

The object of the two separate refrigerant paths interfacing within the confined space of accumulator 62 is to promote the transfer of heat from the hot liquid container 57 to the cold gas entering accumulator inlet 3 as it returns back to compressor 52 through accumulator 62, so that the subcooled liquid that is delivered to expansion valve 61 better enables evaporator 51 to absorb new heat. Further, the layout and configuration of intercooler 100 promotes the complete vaporization of the refrigerant oil that has dropped out of solution with its liquid refrigerant carrier as well residual liquid refrigerant that did not vaporize in evaporator 51, said oil and refirgerant coming from evaporator outlet 2, as described above in the summary of the invention.

It is again noted that hot liquid container 57 may be any shape vessel, including a cylinder, that affords passage of hot liquid from condenser 53 to evaporator 51. However, the preferred embodiment of container 57 is coiled tubing 67, as depicted in FIG. 1. Still referring to FIG. 1, it is important to observe that the cold gaseous refrigerant passes upward from its lower entry fitting accumulator inlet 3 across the hot liquid container 57 (coiled tubing 67) and exits at the higher outlet fitting accumulator outlet 4. The result of the upward flow assures that the cold gas passes across the hot liquid coiled tubing 67 (container 57) to subcool the liquid passing through its full length between the entry fitting for container inlet 9 until its exit at the fitting for container outlet 10. This improved flow pattern of the apparatus creates a more efficient interface for heat transfer than standard accumulators which lack efficient heat exchange capabilities for oil and refrigerant separation because of their cross-draft designs, such as seen in FIGS. 3 and 4, in which both inlet and outlet fittings are located at the top end of the gas chamber. Such cross-draft designs discourage the cold gas from fully sweeping the hot liquid container 57 (coiled tubing 67 in FIG. 1) to fully vaporize the refrigerant and oil as compared with the preferred mode illustrated by FIG. 1. FIGS. 3 and 4 show two variations of standard OEM accumulator designs which position the inlet and outlet points near the top and usually within 3 inches of each other, so that the close proximity of the gas entry and exit (whether stand-up or horseshoe type) results in minimal heat exchange and vaporization efficiencies. Regardless of whether prior art accumulators use an internally affixed gas outlet tube design shaped as a straight standpipe 108 (as in FIG. 4) with a bottom external accumulator outlet 4, or as a curved horseshoe U-pipe 107 (as in FIG. 3) having the interior gas pick-up tube end 106 at the top of the chamber, and accumulator outlet 4 also at the top of the chamber, the 3" inlet-to-outlet distance applies to them both. In both accumulators, the distance between the accumulator inlet 3 and the pick-up tube end (standpipe gas inlet 107 or pick-up tube end 106) is approximately 3".

While hot liquid container 57 has been depicted as being oriented within accumulator interior 68, hot liquid container 57, preferably in the embodiment of coiled tubing 67, may be wrapped around the exterior of accumulator interior 68 to promote the heat transfer. The exterior of accumulator 62 is colder than coiled tubing 67, and thus heat is transferred from coiled tubing 67, and thus the hot liquid refrigerant, to the colder exterior surface of accumulator 62. Typically, this is a less efficient embodiment since the exterior of accumulator 62 is not as cold as accumulator interior 68.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A refrigerant intercooler for a cooling system having a condenser, an evaporator and a compressor, said intercooler comprising:

an accumulator having an accumulator inlet for receiving a cold oily gas refrigerant and a refrigerant oil from said evaporator and an accumulator outlet for discharging said cold oily gas refrigerant and said refrigerant oil from said accumulator to said compressor;

said accumulator having a bottom region where condensed cold oily refrigerant may accumulate;

said inlet in said accumulator bottom region;

said accumulator outlet being higher and set apart from said accumulator inlet;

a container oriented within an interior of said accumulator;

said container in thermal communication with said cold oily gas refrigerant and said refrigerant oil;

said container having a container inlet for receiving a hot oily liquid refrigerant from said condenser and a container outlet for discharging said oily liquid refrigerant to said evaporator; and an oil return line external to said accumulator and in fluid communication between a bottom of said interior of said accumulator and said accumulator outlet.

2. The refrigerant intercooler as in claim 1, further comprising:

said container for receiving said oily liquid refrigerant from said condenser comprising a coiled tubing.

3. The refrigerant intercooler as in claim 1, further comprising:

said container for receiving said oily liquid refrigerant from said condenser comprising a serpentine tubing.

4. The refrigerant intercooler as in claim 1, further comprising:

said oil return line comprising an oil bleed orifice for metering an unvaporized said cold oily gas refrigerant and an unvaporized said refrigerant oil to said accumulator outlet.

5. The refrigerant intercooler as in claim 4, further comprising said oil bleed orifice being changeable.

6. The refrigerant intercooler as in claim 1, further comprising:

said oil return line comprising a cleanable removable oil return screen.

7. The refrigerant intercooler as in claim 6, further comprising an oil bleed orifice for metering an unvaporized said cold oily gas refrigerant and an unvaporized said refrigerant oil to said accumulator outlet.

8. The refrigerant intercooler as in claim 7, further comprising said oil bleed orifice being changeable.

9. A method of promoting vaporization of a cold oily liquid refrigerant and a refrigerant oil received from an evaporator in a cooling system having a condenser, said evaporator and a compressor, said method comprising:

orienting an accumulator between said evaporator and said compressor;

passing said cold oily liquid refrigerant and said refrigerant oil through an interior of said accumulator, front at accumulator inlet in a lower region of said accumulator, to a higher accumulator outlet whereby said cold oily refrigerant is forced to move upward in said accumulator, and across an exterior surface of a container oriented within said interior of said accumulator;

passing a hot oily liquid refrigerant from said condenser through said container;

discharging said cold oily liquid refrigerant at said refrigerant oil, after said cold oily liquid refrigerant and said refrigerant oil have been vaporized, from said accumulator through said higher accumulator outlet to said compressor; and passing a residual said cold oily liquid refrigerant and said refrigerant oil through an oil return line external to said accumulator and in fluid communication between a bottom said interior of said accumulator and said higher accumulator outlet.

10. The method as in claim 9, wherein said hot oily liquid refrigerant from said condenser is in thermal communication with said cold oily liquid refrigerant, said refrigerant oil and a cold gas refrigerant from said evaporator.

11. The method as in claim 9, wherein said container for receiving said hot oily liquid refrigerant from said condenser comprises a coiled tubing.

12. The method as in claim 9, wherein said container for receiving said hot oily liquid refrigerant from said condenser comprises a serpentine tubing.

13. The method as in claim 9, wherein said oil return line comprises a changeable oil bleed orifice for metering said cold oily liquid refrigerant and said refrigerant oil to said higher accumulator outlet.

14. The method as in claim 13, wherein said oil return line comprises a cleanable removable oil return screen.

15. A refrigerant intercooler for a cooling system having a condenser, an evaporator and a compressor, said intercooler comprising:

an accumulator having an accumulator inlet for receiving a cold oily gas refrigerant and a refrigerant oil from said evaporator;

said accumulator further comprising an accumulator outlet for discharging said oily gas refrigerant and said refrigerant oil from said accumulator to said compressor;

said accumulator having a bottom region where condensed cold oily refrigerant may accumulate;

said inlet in said accumulator bottom region;

said accumulator outlet being higher and set apart from said accumulator inlet;

a container oriented about an exterior of said accumulator;

said container being in thermal communication with said accumulator;

said container having a container inlet for receiving a hot oily liquid refrigerant from said condenser and a container outlet for discharging said oily liquid refrigerant to said evaporator; and an oil return line external to said accumulator, said oil return line providing fluid communication between a bottom of said interior of said accumulator and said accumulator outlet for an unvaporized cold oily refrigerant and an unvaporized said refrigerant oil from said evaporator.

16. The refrigerant intercooler as in claim 15, said oil return line further comprising an oil bleed orifice for metering said unvaporized cold oily refrigerant and said unvaporized refrigerant oil to said accumulator outlet.

17. The refrigerant intercooler as in claim 16, further comprising said oil bleed orifice being changeable.

18. The refrigerant intercooler as in claim 15, said oil return line further comprising a cleanable removable oil return screen.

19. A method of removing saturated heat from a hot oily liquid condenser refrigerant received from a condenser in a cooling system having said condenser evaporator and a compressor, said method comprising:

orienting an accumulator between said evaporator and said compressor;

passing a cold oily evaporator refrigerant received from said evaporator through an interior of said accumulator, in an accumulator inlet in a lower region of said accumulator, and out a higher accumulator outlet whereby said cold oily gas refrigerant is forced to move upward in said accumulator;

orienting a container proximate said accumulator;

passing said hot oily liquid condenser refrigerant from said condenser through said container;

transferring heat from said hot oily liquid condenser refrigerant to said cold oily evaporator refrigerant;

discharging said oily liquid condenser refrigerant to said evaporator; and passing a residual liquid said cold oily evaporator refrigerant and a refrigerant oil through an oil return line, said oil return line being external to said accumulator and in fluid communication between a bottom of said interior of said accumulator and said higher accumulator outlet.

20. The method as in claim 19, wherein said container for receiving said hot oily liquid condenser refrigerant from said condenser comprises a coiled tubing.

21. The method as in claim 19, wherein said container for receiving said hot oily liquid condenser refrigerant from said condenser comprises a serpentine tubing.

22. The method as in claim 19, wherein said container is oriented within said interior of said accumulator.

23. The method as in claim 19, wherein said container is oriented proximate an exterior of said accumulator.

24. The method as in claim 19, wherein said oil return line comprises a changeable oil bleed orifice for metering said residual liquid cold oily evaporator refrigerant and said refrigerant oil to said higher accumulator outlet.

25. The method as in claim 24, wherein said oil return line comprises a cleanable removable oil return screen.

* * * * *